US005516373A

United States Patent [19]

Dries et al.

[11] Patent Number: 5,516,373

[45] Date of Patent: May 14, 1996

[54] HIGH PERFORMANCE STEEL STRAPPING FOR ELEVATED TEMPERATURE SERVICE AND METHOD THEREOF

[75] Inventors: Gregory A. Dries, Harrison City, Pa.; Philip M. Roberts, Naperville, Ill.

[73] Assignees: USX Corporation, Pittsburgh, Pa.; Illinois Tool Works, Inc., Glenview, Ill.

[21] Appl. No.: 391,926

[22] Filed: Feb. 21, 1995

[51] Int. Cl.[6] ..... C22C 38/02; C21D 8/02

[52] U.S. Cl. ..... 148/320; 148/547; 148/654

[58] Field of Search ..... 148/320, 650, 148/651, 654, 547; 420/123, 124

[56] References Cited

U.S. PATENT DOCUMENTS

| | | | |
|---|---|---|---|
| 1,952,575 | 3/1934 | Anderson . | |
| 1,979,594 | 11/1934 | Williams . | |
| 3,725,049 | 4/1973 | Satoh et al. . | |
| 3,726,724 | 4/1973 | Davies et al. . | |
| 3,795,506 | 3/1974 | Yamauchi et al. . | |
| 4,435,157 | 3/1984 | Buhler et al. . | |
| 4,533,405 | 8/1985 | Sponseller et al. . | |
| 4,544,406 | 10/1985 | Yamamoto et al. . | |
| 4,816,090 | 3/1989 | Doonan et al. | 148/320 |
| 4,880,477 | 11/1989 | Hayes et al. | 148/639 |
| 4,961,904 | 10/1990 | Beswick . | |
| 5,017,335 | 5/1991 | Bramfitt et al. . | |
| 5,100,613 | 3/1992 | Bodnar et al. . | |
| 5,122,337 | 6/1992 | Lund et al. . | |

FOREIGN PATENT DOCUMENTS

| | | | |
|---|---|---|---|
| 806140 | 2/1969 | Canada | 148/651 |
| 53-43022 | 4/1978 | Japan . | |
| 464653 | 3/1975 | U.S.S.R. | 148/320 |

*Primary Examiner*—Deborah Yee

*Attorney, Agent, or Firm*—Armstrong, Westerman, Hattori, McLeland & Naughton

[57] ABSTRACT

Improved steel strapping and method for producing comprising adding to a steel composition of about 0.25 to about 0.34 wt. % carbon, about 1.20 to about 1.55 wt. % manganese and up to about 0.035 wt. % silicon, an addition consisting of about 0.20 to about 0.25 wt. % vanadium, or 0.35 to about 0.45 wt. % molybdenum, or about 0.35 to about 0.45 wt. % molybdenum plus about 0.12 to about 0.18 wt. % vanadium, casting, hot rolling and cold rolling the steel to strapping form and austempering the steel strapping.

6 Claims, 1 Drawing Sheet

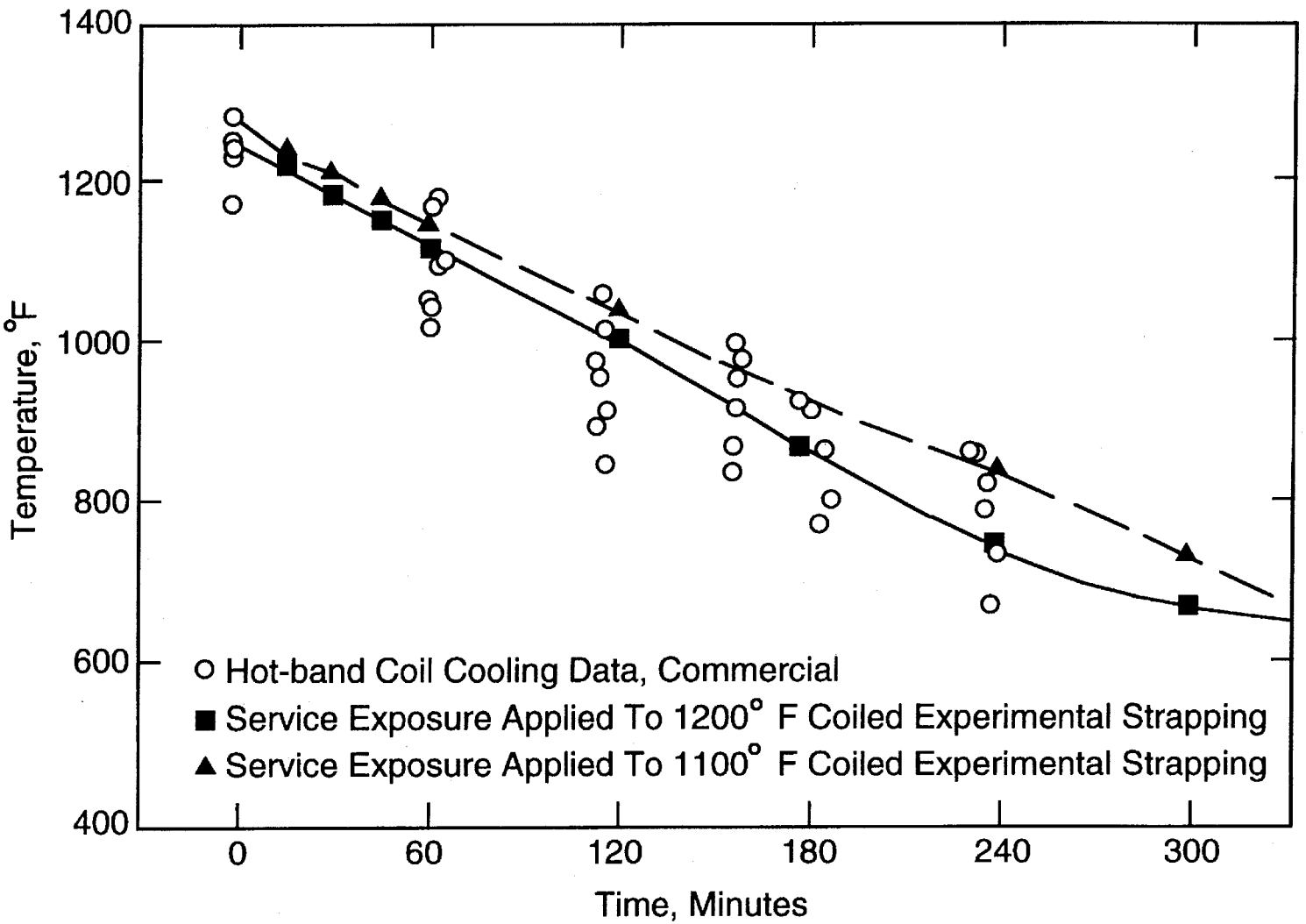
1400
1200
1000
800
600
400
Temperature, °F
0
60
120
180
240
300
Time, Minutes
○ Hot-band Coil Cooling Data, Commercial
■ Service Exposure Applied To 1200° F Coiled Experimental Strapping
▲ Service Exposure Applied To 1100° F Coiled Experimental Strapping

HIGH PERFORMANCE STEEL STRAPPING FOR ELEVATED TEMPERATURE SERVICE AND METHOD THEREOF

BACKGROUND

1. Field of the Invention

This invention relates to steel strapping and a method of manufacture, particularly to steel strapping which is intended for high temperature use, as in strapping hot steel coils, and which, after prolonged exposure at such high temperatures, exhibits superior strength retention.

2. Description of the Prior Art

It is usual to band hot rolled and coiled steel and hot tubular or bar steel products with steel strapping. Such strapping usually is produced from carbon/manganese steel, typically Containing on the order of 0.25 to 0.34 weight percent carbon and 1.20 to 1.55 weight percent manganese. The tensile strength of such conventional steels is substantially reduced on prolonged exposure to the prevailing high temperatures, e.g. about 1200° F.

It is known that the combined addition of molybdenum and vanadium to carbon/manganese steels provides high strength at elevated temperatures (750° F. to 1000° F.), for example in U.S. Pat. No. 1,979,594. In that patent, steel of improved ductility and stress/shock resistance is achieved in a steel containing 0.10 to 0.30 weight percent carbon and 1.5 to 2.5 weight percent manganese, by the addition of 0.15 to 0.30 weight percent molybdenum and 0.05 to 0.30 weight percent vanadium, and processed either by annealing, normalizing or water quenching the steel, followed by drawing at 1100° F.

Closely related technology exists with the alloying utilized in tool steels which also are alloyed with additions of vanadium, molybdenum and chromium. When heat-treated, tool steels exibit very high hardnesses and the ability to hold their hardness at elevated temperatures. The levels of alloying within this class of steels is much higher than with the present invention, with typical levels ranging from 0.5% to over 20%. Typically, the additions of vanadium and molybdenum exceed 1%, and are higher when temper resistance is required for the steel. For example, vanadium is a known addition to high carbon, e.g. 0.80–1.50% C, tool steels to improve hardness, for example as described in U.S. Pat. No. 1,952,575.

Oil well tubular products have been produced of carbon, manganese, silicon high strength, low alloy steels containing about 0.2 to 0.4% molybdenum, for example as described in U.S. Pat. No. 4,533,405.

As shown in U.S. Pat. No. 3,725,049, vanadium is known to enhance tensile strength, e.g. in steels containing 0.06–0.30% C, 0.30–1.5% Mn, up to 0.02% Si, and up to 0.02% acid soluble Al, and 0.02–0.40% V.

SUMMARY OF THE INVENTION

This invention has as an objective the provision of a steel composition containing restricted amounts of carbon and manganese, i.e. 0.25 to 0.34 weight percent carbon and 1.20 to 1.55 weight percent manganese, molybdenum, i.e. 0.35 to 0.45 weight percent Mo, vanadium, i.e. 0.20 to 0.25 weight percent V, or a combination of 0.35–0.45% Mo and 0.12–0.18% V, hot rolling the steel, cold rolling and then austempering a cold-reduced strip to provide a strapping product of enhanced yield and tensile strength which is largely retained after prolonged exposure to elevated temperatures on the order of 1200° F. e.g. as exhibited by hot coils of steel banded with the strapping.

BRIEF DESCRIPTION OF THE DRAWING

FIG. 1 is a graph relating time and temperature of simulated service exposure of the steel strapping of the invention which is nearly identical to the service exposure conditions of banding on hot-rolled steel coils after hot rolling and during cool-down.

DESCRIPTION OF PREFERRED EMBODIMENTS

This invention contemplates the addition of vanadium alone, or molybdenum alone, or a combination of vanadium and molybdenum to a medium-carbon manganese steel for the enhancement of properties after the steel is cold-reduced and austempered to produce steel strapping.

The composition of steel currently used for the banding of hot-steel products is shown in Table 1, along with the inventive steel compositions.

TABLE 1

| | Steel Compsition (weight percent) | | | | |
|---|---|---|---|---|---|
| | C | Mn | Si | Mo | V |
| Conventional Steel | 0.25–0.34 | 1.20–1.55 | 0.035 max | — | — |
| V modified | 0.25–0.34 | 1.20–1.55 | 0.035 max | — | 0.20–0.25 |
| Mo modified | 0.25–0.34 | 1.20–1.55 | 0.035 max | 0.35–0.45 | — |
| V & Mo modified | 0.25–0.34 | 1.20–1.55 | 0.035 max | 0.35–0.45 | 0.12–0.18 |

Conventional strapping was prepared by hot rolling the continously cast conventional steel to about 0.1 inch gage, coiling at about 1200° F., pickling and cold rolling to 0.03–0.04 inch gage, and slitting to strapping width—about 1.25 inches. The modified steels were similarly produced. Both the conventional and the modified steels then were austempered by passing the strip through a first lead bath to preheat the strip to about 850° F.; then resistance heated to about 1600° F.; then passed through a second lead bath at about 800° F. to quench the strip (and held at this temperature for about 8 seconds); allowed to air-cool to about 250° F., and then followed by water cooling to room temperature. The austempering step is carried out during a period of about 60–70 seconds. The resulting product has a non-equilibrium microstructure of very fine spheroidized carbides in ferrite. After such processing, the strapping product is painted, waxed and coiled.

The conventional and modified steel strapping then was subjected to simulated service exposure which duplicated the service environment of steel bands on hot-coiled steel, as shown in FIG. 1.

Table 2 shows the properties of the inventive strapping alloys compared to conventional steel strapping, both as-produced and after a simulated service exposure (the banding of a hot-rolled coil).

TABLE 2

| | As-Produced Strapping Strength, ksi | | Strapping Strength After Simulated Service, ksi | | Percent Tensile Strength Retained |
|---|---|---|---|---|---|
| | YS | Ts | Ys | Ts | % |
| Conventional Strapping | 141.6 | 148.0 | 80.7 | 83.8 | 56.6 |
| V modified | 148.9 | 157.2 | 101.5 | 103.3 | 65.7 |
| Mo modified | 134.9 | 150.3 | 90.3 | 92.7 | 61.7 |
| V & Mo modified | 145.8 | 159.4 | 118.2 | 120.2 | 75.4 |

The data of Table 2 illustrate the superior tensile properties of the invented steels after such simulated service exposure.

The uniquely alloyed steel strapping of the invention, when heat treated as above described, exhibits a superior ability to resist tempering and maintain tensile properties during prolonged exposure at elevated temperature, up to around 1200° F. and above, thus allowing lighter gage strapping to be used for hot applications, and providing a cost savings for the user.

What is claimed is:

1. A method for producing steel strapping of enhanced tensile strength on prolonged exposure to elevated temperatures comprising providing a steel composition consisting essentially of, by weight percent, about 0.25% to about 0.34% carbon, about 1.20% to about 1.55% manganese, and up to about 0.035% silicon, modifying said steel by an addition selected from the group consisting of from about 0.20% to about 0.25% vanadium, from about 0.35% to about 0.45% molybdenum, and from about 0.35% to about 0.45% molybdenum plus from about 0.12% to about 0.18% vanadium, casting the steel, hot rolling the steel to strip form, cold rolling the steel strip to strapping gage, slitting the cold-rolled steel strip to strapping width, and austempering the steel before or after slitting to strapping width.

2. A method according to claim 1, wherein the austempering step comprises preheating the strapping to about 850° F., heating the preheated strapping to about 1600° F., quenching the heated strapping to about 800° F. and holding at this temperature for about 8 seconds, air-cooling the quenched strapping to about 250° F., and water-cooling the strapping to room temperature.

3. A method according to claim 2, wherein the preheating of the strapping is carried out in a first molten-lead bath, heating of the preheated steel is done by resistance heating, and quenching of the heated strapping is carried out in a second molten-lead bath.

4. Steel strapping produced from a steel composition consisting essentially of, by weight percent, 0.25% to 0.34% carbon, 1.2% to 1.55% manganese, 0.035% maximum silicon, and a high temperature strengthening component selected from the group consisting of from about 0.20% to about 0.25% vanadium, from about 0.35% to about 0.45% molybdenum, and from about 0.35% to about 0.45% molybdenum plus from about 0.12% to about 0.18% vanadium, wherein the steel has been hot rolled, cold rolled to strapping gage, slit to strapping width, and, before or after slitting, has been austempered, providing a non-equilibrium microstructure of fine spheroidized carbides in ferrite, said strapping having enhanced retention of tensile strength after prolonged exposure to elevated temperatures as compared to the steel free of said strengthening component.

5. Strapping according to claim 4, wherein the austempering step comprises preheating the steel to about 850° F., heating the preheated steel to about 1600° F., quenching the heated steel to about 800° F. and holding at this temperature for about 8 seconds, air-cooling the quenched steel to about 250° F., and water-cooling the steel to room temperature.

6. Strapping according to claim 5, wherein preheating the steel is carried out in a first molten lead bath, heating of the preheated steel is done by resistance heating, and quenching of the heated steel is carried out in a second molten lead bath.

* * * * *